US005271484A

United States Patent [19]

Bahjat et al.

[11] Patent Number: 5,271,484

[45] Date of Patent: Dec. 21, 1993

[54] SELECTABLE NOTIFICATION TIME INDICATING ELEVATOR CAR ARRIVAL

[75] Inventors: Zuhair S. Bahjat, Farmington; Joseph Bittar, Avon, both of Conn.

[73] Assignee: Otis Elevator Company, Farmington, Conn.

[21] Appl. No.: 683,141

[22] Filed: Apr. 10, 1991

[51] Int. Cl.[5] ..... B66B 1/18

[52] U.S. Cl. ..... 187/29.1

[58] Field of Search ..... 187/124, 130, 131, 121, 187/137, 127, 101, 29, 129, 29 R

[56] References Cited

U.S. PATENT DOCUMENTS

| | | | |
|---|---|---|---|
| 4,064,971 | 12/1977 | Iwasaka et al. | 187/137 |
| 4,323,142 | 4/1982 | Bittar | 187/29 R |
| 4,363,381 | 12/1982 | Bittar | 187/127 |
| 4,799,243 | 1/1989 | Zepke | 377/6 |
| 4,815,568 | 3/1989 | Bittar | 187/127 |
| 4,901,822 | 2/1990 | Tsuji | 187/127 |
| 4,915,197 | 4/1990 | Schroder | 187/131 |
| 4,947,965 | 8/1990 | Kuzunuki et al. | 187/127 |
| 4,989,694 | 2/1991 | Ueshima et al. | 187/121 |
| 4,989,695 | 2/1991 | Kubo | 187/101 |
| 5,004,076 | 4/1991 | Chen et al. | 187/130 |
| 5,042,620 | 8/1991 | Yoneda et al. | 187/124 |
| 5,092,431 | 3/1992 | Schroder | 187/127 |

*Primary Examiner*—A. D. Pellinen
*Assistant Examiner*—S. Jackson
*Attorney, Agent, or Firm*—Joseph P. Abate; Melvin P. Williams

[57] ABSTRACT

The present invention is directed to notifying a user of an arriving elevator car in response to a hall call registered by the user, wherein notification occurs a threshold time value before elevator car arrival. In the preferred embodiment, an elevator car is assigned to a floor in response to a hall call. The amount of time required for the assigned elevator car to arrive at the floor is determined and compared with the threshold time value. If the arrival time is greater than the threshold time value, the system reexamines assignment, possibly reassigning a different elevator car to respond to the hall call. The arrival time of the assigned (or newly assigned) elevator car is again determined, and this process continues until the arrival time is less than or equal to the threshold time value. When the arrival time is less than or equal to the threshold time value, the hall lantern at the door of the assigned elevator car is energized, e.g., illuminated and/or sounded. Additionally, the hall call is removed from further consideration regarding reassignment to another elevator car, thereby fixing the elevator car assignment. In the preferred embodiment, the threshold time value can be a constant value determined by, e.g., the building manager. Alternatively, the threshold time value can be variable by the system, e.g., based on the intensity of the traffic as measured by user waiting time or user boarding and/or deboarding rates, whether actual or predicted.

10 Claims, 2 Drawing Sheets

SELECTABLE NOTIFICATION TIME INDICATING ELEVATOR CAR ARRIVAL

BACKGROUND OF THE INVENTION

1. Technical Field

The present invention is directed to notifying a user of an arriving elevator car. More particularly, the present invention is directed to notifying a user as to which elevator car will be responding to a hall call registered by the user, wherein notification occurs a selectable amount of time before the elevator car arrives.

As used herein, notifying a user means energizing, e.g., sounding and/or illuminating, a hall lantern (which usually includes audible and visible alarms) located at or near the elevator car which will be responding to the hall call, thereby indicating to the user which elevator car will be arriving.

2. Background Information

In a building having a plurality of floors, each floor typically has a set of buttons located in the hallway at or near the elevators. These buttons, commonly referred to as hall call buttons, enable users to request elevator car service in a predetermined direction, i.e., up and/or down. Additionally, the interior of an elevator car is generally equipped with a plurality of buttons, commonly referred to as car call buttons, which enable users to request service to specific floors.

In simplified terms, an elevator control system, also referred to in the art as an elevator dispatching system, monitors the status of the hall call buttons at the floors and car call buttons in the elevator cars, assigning elevator cars to the floors in response to hall calls registered at the floors and/or car calls registered in the elevator car.

Several dispatching techniques are known in the art, e.g., dispatching based on static or dynamic sectors, peak-period dispatching (e.g., up-peak, down-peak and noon-time) and dispatching based on bonuses and/or penalties, e.g., the Relative System Response (RSR) methodology proprietary to the assignee of the present invention.

Typically, a user is notified as to which elevator car will be responding to the hall call in one of two ways: immediately or at the last possible moment, i.e., when the elevator car commits to stop at the floor registering the hall call.

In Japan, users typically want to be informed as to which elevator car will be responding to the hall call almost immediately upon hall call registration. In this way, the users can wait near the door of the elevator car which will be responding to the hall call. Thus, in dispatching systems commonly referred to as having instantaneous car assignment, the hall lantern is energized at the time of initial elevator car assignment, which occurs about the time the hall call is registered.

In RSR systems which employ instantaneous car assignment, since the hall lantern is energized at the time of initial elevator car assignment, the system attempts to maintain the integrity of the initial assignment, e.g., by heavily favoring the initial elevator car assignment. In practice, the elevator car which receives the initial assignment is usually the elevator car which responds to the hall call.

In the other types of systems, herein referred to as conventional systems, the hall lantern is energized when the elevator car commits to stop at the floor registering the hall call. As used herein, an elevator car commits when it begins to decelerate so as to come into position and stop at the floor registering the hall call.

The point in time at which the elevator car commits is herein referred to as the stop control point (SCP). The SCP varies since it is dependent upon several factors including the speed of the elevator car, its deceleration rate and its position with respect to the floor. Typically, however, the SCP occurs about 3 to 5 seconds before the elevator car arrives at the floor.

In conventional systems which employ RSR dispatching, the system initially assigns an elevator car to respond to the hall call at the time the hall call is registered. Subsequently, however, the system can reassign a different elevator car to respond to the hall call if the subsequent assignment will be more suitable, that is provide faster response or improved system performance. In order to improve RSR dispatching efficiency, the decision regarding possible reassignment occurs often, e.g., on the order of every second. Since the hall lantern is energized at the time the assigned elevator car commits to the floor, reassignment is transparent to the user.

To improve system efficiency, the elevator car door begins to open before the car fully stops at the floor so that the door is almost completely open when the car stops. Regardless of which dispatching technique is used, the door will typically remain open a fixed time in response to a hall call (e.g., about 4 seconds) or a fixed time in response to a car call (e.g., about 2 seconds).

In conventional systems where notification occurs about 3 to 5 seconds before car arrival, the waiting users have a relatively short amount of time to walk over to and fully board the elevator car before its door begins to close. There are situations where this fixed amount of time might not be satisfactory to accommodate all users wishing to board the elevator car before the door begins to close.

For example, where a rather large number of users are in the hallway, boarding time will increase. Also, if the waiting area where users congregate is relatively large, and a user is stationed relatively far away from the elevator car, this fixed time may not be long enough to accommodate the user. This is especially true in cross-traffic conditions and/or where the user is only partially ambulatory, e.g., due to an injury, a handicap or old age.

SUMMARY OF THE INVENTION

Accordingly, it is an object of the present invention to notify a user of an arriving elevator car in response to a hall call registered by the user, wherein notification occurs a selectable amount of time before the elevator car arrives, thereby providing the user with the selectable amount of time in which the user may move towards the arriving elevator car door.

It is also an object of the present invention to notify a user of an arriving elevator car in response to a hall call a selectable amount of time before the elevator car arrives, wherein the selectable amount of time is independent of both the time corresponding to the SCP and the time the hall call is registered.

In accordance with these and other objects, the present invention is directed to notifying a user of an arriving elevator car in response to a hall call registered by the user, wherein notification occurs a threshold time value before elevator car arrival.

In the preferred embodiment, an elevator car is assigned to a floor in response to a hall call. The amount of time required for the assigned elevator car to arrive at the floor is determined and compared with the threshold time value.

If the arrival time is greater than the threshold time value, the system reexamines assignment, possibly reassigning a different elevator car to respond to the hall call. The arrival time of the assigned (or newly assigned) elevator car is again determined, and this process continues until the arrival time is less than or equal to the threshold time value.

When the arrival time is less than or equal to the threshold time value, the hall lantern at the door of the assigned elevator car is energized, e.g., illuminated and/or sounded. Additionally, the hall call is removed from further consideration regarding reassignment to another elevator car, thereby fixing the elevator car assignment.

In the preferred embodiment, the threshold time value can be a constant value determined by, e.g., the building manager. Alternatively, the threshold time value can be variable by the system, e.g., based on the intensity of the traffic as measured by user waiting time or user boarding and/or deboarding rates, whether actual or predicted.

By notifying a user of an arriving elevator car a selectable amount of time before car arrival, based on the value of the threshold time value, the present invention provides earlier notification for users to position themselves at the arriving elevator car door, relative to conventional prior art dispatching systems. Further, the present invention enables the dispatching system to be more efficient, relative to prior art dispatching systems utilizing instantaneous car assignment, since the car assignment may be optimally selected until the elevator car is the threshold time value away from the floor, as opposed to being selected at; the time the hall call was registered.

DESCRIPTION OF THE PREFERRED EMBODIMENT(S)

The dispatching and operation of the elevator car is controlled by an elevator control system, preferably as described in DE/EP 0,239,662 to Auer et al., published Oct. 7, 1987 (corresponding to U.S. application Ser. No. 029,495, filed Mar. 23, 1987), herein incorporated by reference, and shown with reference to FIG. 1. It is to be understood, however, that the present invention can be used with any other elevator control system, including but not limited to U.S. Pat. No. 4,363,381 to Bittar, herein incorporated by reference.

Figure 1:
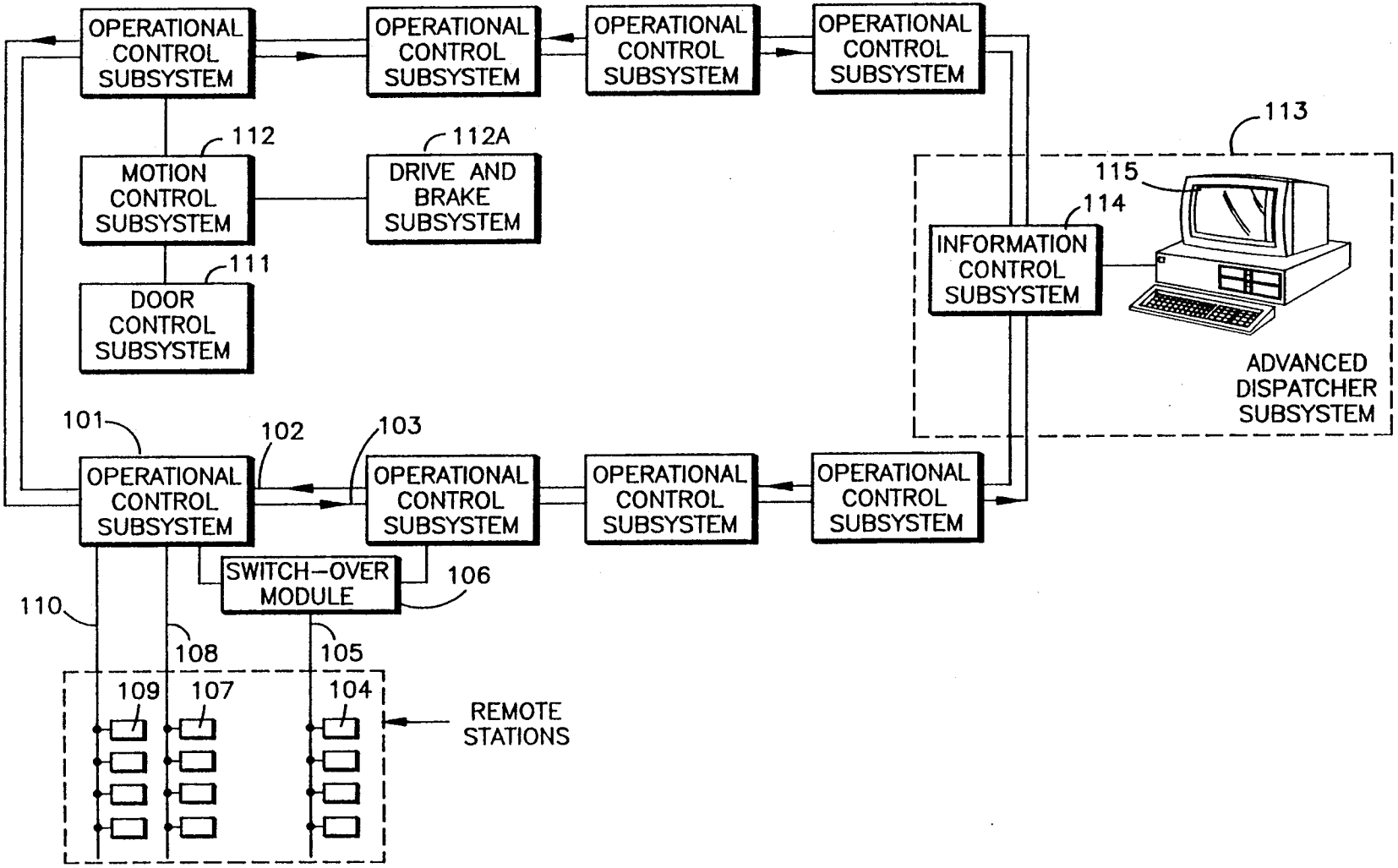
fig. 1 prior art
FIG. 1 depicts an exemplary elevator control system.

Turning now to FIG. 1, an exemplary elevator control system is shown. Each elevator car has operational control subsystem (OCSS) 100, 101 which communicates to every other OCSS in a ring communication system via lines 102, 103. It is to be understood that each OCSS has various circuitry connected thereto. However, for the sake of simplicity, the circuitry associated 101 with only one OCSS will be described.

Hall call buttons and their associated lights and circuitry (not shown) are connected to an OCSS via remote stations 104, remote serial communication link 105 and switch-over module (SOM) 106. Car buttons and their associated lights and circuitry (not shown) are connected to an OCSS via remote stations 107 and remote serial communication link 108. Hall lanterns, indicating e.g. the direction of travel of the car which is to stop and/or which set of doors will be opened to accommodate the elevator car which is to stop, and their associated lights (and/or alarms and circuitry (not shown) are connected to an OCSS via remote station 109 and remote serial communication link 110.

The operation of the elevator car door is controlled by door control subsystem (DCSS) 111. The movement of the elevator car is controlled by motion control subsystem (MCSS) 112, which operates in conjunction with drive and brake subsystem (DBSS) 112A. Dispatching is determined and executed by the OCSS with additional inputs generated by advanced dispatching subsystem (ADSS) 113, which can be implemented with a; computer 115 communicating via information control subsystem (ICSS) 114.

The DCSS preferably determines the load of the elevator car, the load being converted into user boarding and/or deboarding rates by the MCSS. This information can be sent to the ADSS for recordation and prediction of traffic flow in order to increase the efficiency of elevator service. Alternatively, user boarding and/or deboarding rates can be determined by a people sensing/counting arrangement as shown, e.g., in U.S. Pat. No. 4,799,243 issued to Zepke, hereby incorporated by reference.

Figure 2:
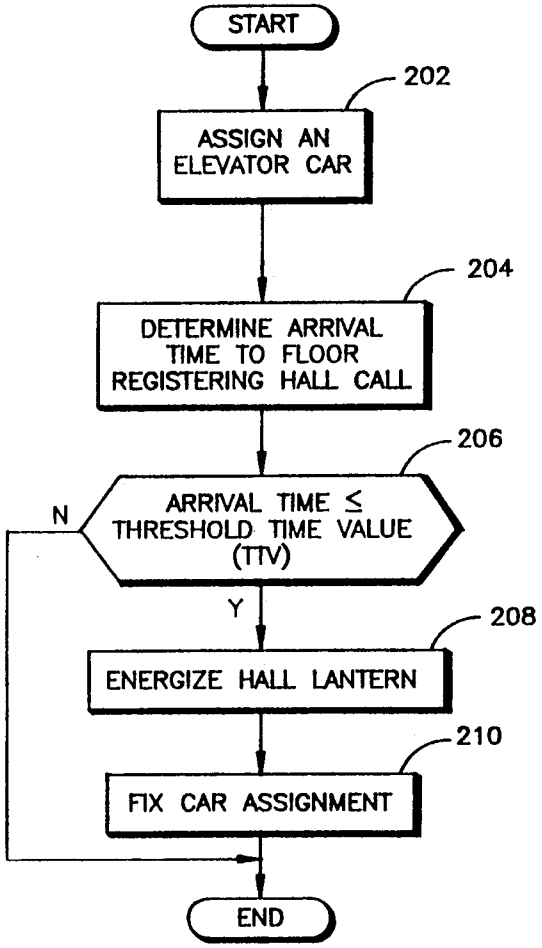
FIG. 2 illustrates a preferred embodiment for notifying a user of an arriving elevator car in response to a hall call registered by the user, wherein notification occurs a predetermined amount of time before the elevator car arrives.

Turning now to FIG. 2, a preferred embodiment for notifying a user of an arriving elevator car in response to a hall call registered by the user is illustrated. In the preferred embodiment, the method of FIG. 2 is performed for each hall call on a periodic basis, e.g., every second.

At step 202, the elevator control system assigns an elevator car in response to a hall call registered by a user. Several dispatching techniques are known in the art, e.g., dispatching based on static or dynamic sectors, peak-period dispatching (e.g., up-peak, down-peak and noon-time) and dispatching based on bonuses and/or penalties, e.g., the Relative System Response (RSR) methodology proprietary to the assignee of the present invention. The present invention is equally applicable regardless of which dispatching technique is employed. The elevator control system, however, preferably employs the RSR system as disclosed in U.S. Pat. No. 4,815,568 or U.S. Pat. No. 4,363,381, both issued to Bittar and herein incorporated by reference.

At step 204, the time required for the assigned elevator car to arrive at the floor registering the hall call is determined. As known in the art, the arrival time is a function of several factors, including but not limited to the speed of the elevator car, its acceleration and deceleration rates, its current position relative to the floor registering the hall call and the number of hall and/or car calls previously assigned thereto.

At step 206, the arrival time is compared with a threshold time value (TTV). The threshold time value can have a constant value or a variable value.

In the preferred embodiment, the threshold time value is a constant value determined by, e.g., a person in charge of elevator or building maintenance. The threshold time value preferably has a value between about 4 and about 15 seconds, and more preferably about 9 seconds.

However, the range and the preferred value for TTV is an empirical quantity which is preferably a function of the desires of the building manager and the specific building configuration and its traffic patterns. As used herein, building configuration means the physical attributes of the building which impact traffic flow therethrough, including but not limited to number of floors, number of elevators, elevator speed, location of express zone(s), location of lobby level and/or parking level(s), total building population, and distribution of the population per floor.

Alternatively, the threshold time value can be variable by the system. As discussed in more detail with reference to FIG. 3, the threshold time value can be varied by the system, e.g., based on the intensity of the traffic as measured by user waiting time or user boarding and/or deboarding rates, whether actual or predicted.

At step 206, if the time required for the assigned elevator car to arrive at the floor registering the hall call is less than or equal to the threshold time value, then at step 208 the system energizes, e.g., illuminates and/or sounds, the hall lantern associated with the assigned elevator car. Additionally, at step 210, the system removes the hall call from further consideration regarding reassignment to another elevator car, thereby fixing the elevator car assignment.

In the event the assigned elevator car is precluded from responding to the hall call, the system reassigns another elevator car to respond to the hall call. An elevator car can be precluded from responding to a hall call, e.g., because it is taken out of service due to a malfunction or the elevator car reaches full capacity before responding to the hall call.

At step 206, if the arrival time of the assigned elevator car is greater than the threshold time value steps 208 and 210 are bypassed; and in the next performance of the method of FIG. 2, steps 202–206 are repeated given the assigned elevator car's current position, speed, and the like. This process continues until the arrival time is less than or equal to the threshold time value.

Figure 3:
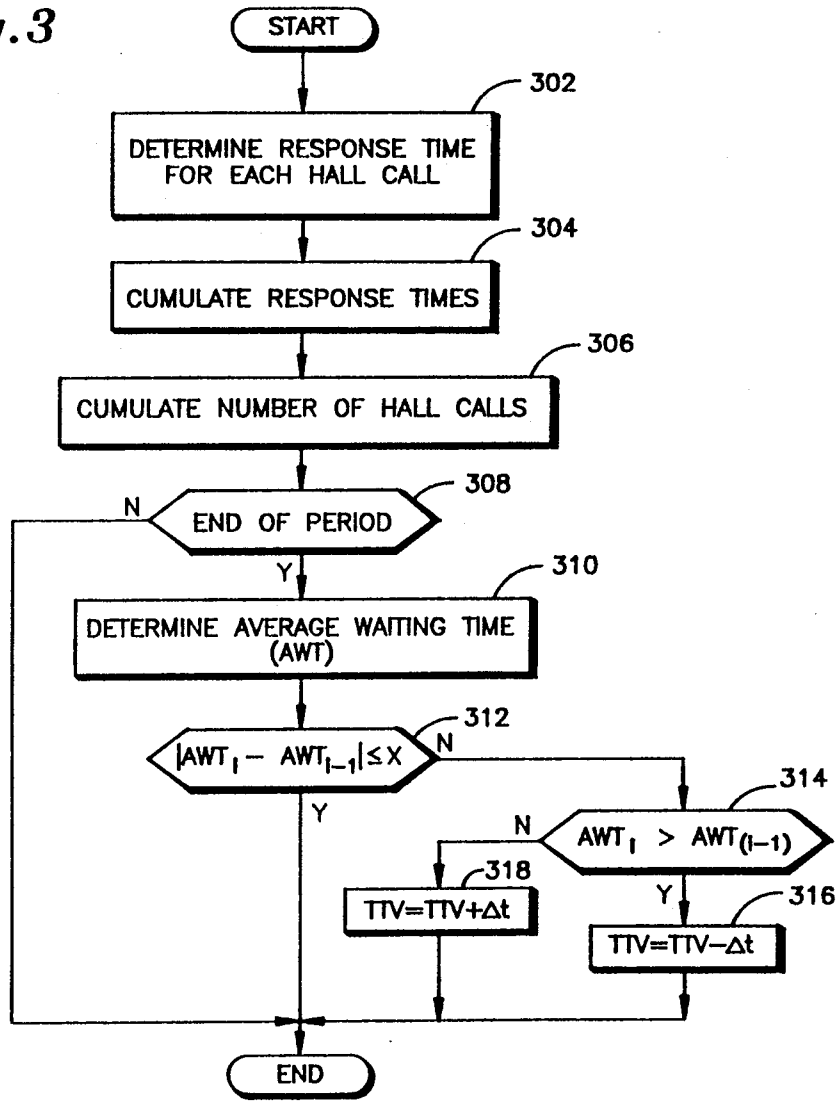
FIG. 3 illustrates a preferred embodiment for varying the predetermined amount of time based on user waiting time.

Turning now to FIG. 3, a preferred embodiment for varying the threshold time value, based on user waiting time, is illustrated.

At step 302, the response time for each hall call is determined. The response time is preferably the time between when the hall call was registered and when the assigned elevator car commits to the floor registering the hall call. Other response time determinations will be obvious to those in the art.

At step 304, the response time for all hall calls is cumulated, and at step 306 the number of hall calls comprising the cumulated response time is cumulated. This process continues until the end of each period (step 308). In the preferred embodiment, each period is, e.g., 3 to 5 minutes. Other periodic rates, e.g., based on the specific building configuration and its traffic patterns, will be obvious to those skilled in the art.

At step 310, the average waiting time (AWT) for the period is determined. In the preferred embodiment, the average waiting time is equal to the cumulated response times (of step 304) divided by the cumulated number of hall calls (of step 306). Alternatively, average waiting time for the period can be determined by dividing the period by the number of hall calls to which an elevator car responded during the period.

At step 312, the absolute value of the difference between average waiting time of the period which just ended, $AWT_i$, and the average waiting time of the period previous thereto, $AWT_{i-1}$, is determined.

If the absolute value of this difference is less than or equal to a predetermined tolerance x, threshold time value TTV of step 206 (FIG. 2) is not varied by the system. However, if the absolute value of this difference is greater than predetermined tolerance x, threshold time value TTV is varied.

At step 314, if $AWT_i$ is greater than $AWT_{i-1}$, then users during the period which just ended are waiting longer than they waited during the period previous thereto. Thus, at step 316, threshold time value TTV is decreased by $\Delta t$. In this way, the dispatching system finalizes its elevator car assignment later, increasing the efficiency of the dispatching system to lower user waiting time.

At step 314, if $AWT_i$ is less than or equal to $AWT_{i-1}$, then users during the period which just ended are waiting less time than they waited during the period previous thereto. Thus, at step 318, threshold time value TTV is increased by $\Delta t$. Thus, the user will be notified of an arriving elevator car at an earlier time. Earlier notification will appear, at least psychologically, that the user is obtaining faster response. Earlier notification should not greatly affect system performance, since a lower average waiting time corresponds to high system efficiency and/or relatively low traffic volume.

In the preferred embodiment, the initial value of threshold time value TTV is between about 4 and about 15 seconds, and more preferably about 9 seconds. The value of predetermined tolerance x is between about 5 and about 10 seconds, more preferably about 5 seconds. The value of $\Delta t$ is between about 0.5 and about 5 seconds, more preferably about 1 second. However, the ranges and the preferred values for the threshold time value, predetermined tolerance x and $\Delta t$ are empirical quantities which are preferably a function of the specific building configuration and its traffic patterns.

In another embodiment, the threshold time value can be varied based user boarding and/or deboarding rates, whether actual or predicted. Determining actual and/or predicted boarding and/or deboarding rates is known in the art. See, e.g. U.S. Pat. No. 5,022,497 and U.S. Pat. No. 5,024,295, both issued to Thangavelu and herein incorporated by reference.

Where the threshold time value is varied based on actual and/or predicted user boarding and/or deboarding rates, step 312 can be modified to compare the boarding and/or deboarding rates for two consecutive periods. The values of predetermined tolerance x and $\Delta t$ (steps 312 through 318) are preferably empirical quantities based on the specific building configuration, its traffic patterns and/or a percentage of the building population.

By notifying a user of an arriving elevator car a selectable amount of time before car arrival, based on the value of the threshold time value, the present invention provides earlier notification for users to position themselves at the arriving elevator car door, relative to conventional prior art dispatching systems. Further, the present invention enables the dispatching system to be more efficient, relative to prior art dispatching systems utilizing instantaneous car assignment, since the car assignment may be optimally selected until the elevator car is the threshold time value away from the floor, as opposed to being registered at the time the hall call was registered.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What we claim as our invention is:

1. A method of dispatching a plurality of elevator cars to various floors in a building, each specific floor having a hall call means for registering a hall call and a hall lantern corresponding to each elevator, including notifying a user on a specific floor of an elevator car arriving in response to a hall call registered by the user, comprising:

(a) determining, for each elevator car, a value indicative of the suitability of such elevator car for servicing the hall call;

(b) assigning to the specific floor to service the registered hall call, the elevator car which has the value indicating the most suitability to service such hall call;

(c) determining the arrival time of the assigned elevator car at the specific floor;

(d) comparing the determined arrival time to a threshold time value; and (e) alternatively, either energizing the hall lantern corresponding to the assigned elevator car and fixing the elevator car assignment if the determined arrival time is less than or equal to the threshold time value, or repeating steps (a) through (d) if the determined arrival time is greater than the threshold time value.

2. The method of claim 1, said method further comprising the step of varying the threshold time value based on waiting time of users.

3. The method of claim 2, wherein said step of varying the threshold time value based on waiting time of users comprises the steps of:

determining average waiting time of users for a first predetermined time period;

determining average waiting time of users for a second predetermined time period;

comparing the determined average waiting time for the first predetermined time period with the determined average waiting time for the second predetermined time period; and alternatively, either decreasing the value of the threshold time value if the determined average waiting time for the second predetermined time period is less than the determined average waiting time for the first predetermined time period, or increasing the value of the threshold time value if the determined average waiting time for the second predetermined time period is greater than the determined average waiting time for the first predetermined time period.

4. The method of claim 1, said method further comprising the step of varying the threshold time value based on an actual number of users which boarded and/or deboarded the elevator cars during a predetermined period of time.

5. The method of claim 1, said method further comprising the step of varying the threshold time value based on a predicted number of users which will be boarding and/or deboarding the elevator cars during a predetermined period of time.

6. In an elevator system for controlling the dispatching of a plurality of elevator cars to various floors in a building, each specific floor having a hall lantern corresponding to each elevator to indicate at which elevator door to expect the eventual arrival of the respective elevator car, a method of notifying a user of an arriving elevator car in response to a hall call registered by the user at a specific floor, said method comprising the steps of:

(a) assigning an elevator car to the specific floor to service the registered hall call;

(b) determining arrival time of the assigned elevator car to the specific floor;

(c) comparing the determined arrival time to a threshold time value; and (d) alternatively, either energizing the hall lantern corresponding to the assigned elevator car and fixing the elevator car assignment if the determined arrival time is less than or equal to the threshold time value, or repeating steps (a) through (c) if the determined arrival time is greater than the threshold time value.

7. The method of claim 6, said method further comprising the step of varying the threshold time value based on waiting time of uses.

8. The method of claim 7, wherein said step of varying the threshold time value based on waiting time of users comprises the steps of:

determining average waiting time of users for a first predetermined time period;

determining average waiting time of users for a second predetermined time period following said first predetermined time period;

comparing the determined average waiting time for the first predetermined time period with the determined average waiting time for the second predetermined time period; and alternatively, either decreasing the value of the threshold time value if the determined average waiting time for the second predetermined time period is greater than the determined average waiting time for the first predetermined time period, or increasing the value of the threshold time value if the determined average waiting time for the second predetermined time period is less than the determined average waiting time for the first predetermined time period.

9. The method of claim 6, said method further comprising the step of varying the threshold time value based on an actual number of users which boarded and/or deboarded the elevator cars during a predetermined period of time.

10. The method of claim 6, said method further comprising the step of varying the threshold time value based on a predicted number of users which will be boarding and/or deboarding the elevator cars during a predetermined period of time.

* * * * *